US006786584B2

(12) United States Patent
Kaga et al.

(10) Patent No.: US 6,786,584 B2
(45) Date of Patent: Sep. 7, 2004

(54) INK HOUSING DEVICE RELIABLY PREVENTING INK LEAKAGE

(75) Inventors: Hikaru Kaga, Aichi-ken (JP); Katsunori Nishida, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/266,675

(22) Filed: Oct. 9, 2002

(65) Prior Publication Data

US 2003/0067522 A1 Apr. 10, 2003

(30) Foreign Application Priority Data

Oct. 9, 2001 (JP) ..... P2001-311931
Oct. 9, 2001 (JP) ..... P2001-311932
Oct. 9, 2001 (JP) ..... P2001-311933

(51) Int. Cl.[7] ..... B41J 2/175
(52) U.S. Cl. ..... 347/86
(58) Field of Search ..... 347/84, 85, 86, 347/87; 53/416, 434, 477; 607/256

(56) References Cited

U.S. PATENT DOCUMENTS 4,568,954 A * 2/1986 Rosback ..... 346/75
5,221,935 A * 6/1993 Uzita ..... 347/86
5,971,533 A * 10/1999 Kinoshita et al. ..... 347/86

FOREIGN PATENT DOCUMENTS

| | | |
|---|---|---|
| JP | B2 3-34461 | 5/1991 |
| JP | B2 4-5549 | 1/1992 |
| JP | B2 4-21590 | 4/1992 |
| JP | A 4-211963 | 8/1992 |

* cited by examiner

*Primary Examiner*—Anh T. N. Vo
(74) *Attorney, Agent, or Firm*—Oliff & Berridge, PLC

(57) ABSTRACT

An ink accommodating pouch for accommodating ink is produced in the following manner. Two sheets formed of a synthetic resinous material are prepared. Four edges of both the sheets overlap each other and are oriented in the same direction. Three of the aligned edges are fused completely by heat, forming junctions. A resultant product is turned inside out so that the junctions of the three edges are turned inward and protrude inside a pouch. An ink extraction outlet is sealed to the remaining open edge. When the pouch is filled with ink, When the ink accommodating pouch 60 is filled with ink, the sheets near the junctions swell to a protruding curved shape on the outside of the pouch, enabling the pouch to accommodate an increased amount of ink.

13 Claims, 10 Drawing Sheets

INK HOUSING DEVICE RELIABLY PREVENTING INK LEAKAGE

BACKGROUND OF THE INVENTION

1. Field of the Invention

The present invention relates to the construction of an ink accommodating pouch for supplying ink to the print head of an inkjet recording device, such as a piezoelectric type inkjet recording device.

2. Related Art

There have been provided inkjet recording devices that eject ink droplets based on input signals for forming images on such recording mediums as papers.

Japanese published examined patent applications (Kokoku) Nos. HEI-3-34461, HEI-4-5549, and HEI-4-21590, and Japanese Patent-Application Publication (Kokai) No. HEI-4-211963 disclose conventional ink housing devices for use in inkjet recording devices.

FIG. 1 shows an ink housing device disclosed in Japanese published examined patent application (Kokoku) No. HEI-4-5549. As shown in FIG. 1, the ink housing device 100 has a box-shaped cartridge casing 131 accommodating an ink accommodating pouch 120 made of synthetic resin.

A rubber stopper 112 having a small-diameter portion 112*a* at one side, an outer portion 112*c* at opposite side, and a large-diameter portion 112*b* in the middle is fixed inside a through hole formed in the casing 131A. A cavity 114 is formed in the small-diameter portion 112*a* and the large-diameter portion 112*b* to have an opening at the one side. One end of a cylindrical ink outlet 110 is connected to the ink accommodating pouch 120 for leading ink out of the ink accommodating pouch 120. Another end of the ink outlet 110 is engaged inside the cavity 114, so that the rubber stopper 112 seals off the ink outlet 110.

Upper and lower parts 131A, 131B of the casing 131 are formed with grooves in edges, defining a through hole 140 in a joint portion between the upper and lower parts 131A, 131B. The large-diameter portion 112*b* is fit into a circular groove formed in an inner periphery of the through hole 140, whereby the rubber stopper 112 is fixed to the casing 131.

Usually, an ink accommodating pouch used in this type of ink housing device is produced in a following manner. That is, a flexible sheet material having gas barrier properties is folded in halt such that the edges are aligned. Two edges of the layers are joined by thermal fusion (heat sealed). An ink outlet is mounted in remaining one edge of the layers and heat sealed to the sheet. Then, the ink outlet is fitted into a rubber stopper for sealing the pouch.

FIG. 2 shows a cross-sectional view of a conventional ink accommodating pouch 200. Here, an ink accommodating pouch 200 includes two sheets 201*a* and 201*b* placed one over the top of the other and joined together at junctions 202 on the edges of the ink accommodating pouch 200.

SUMMARY OF THE INVENTION

The above described conventional technologies have the following problems.

The configuration of the conventional ink cartridge 100 shown in FIG. 1 requires to form grooves in the upper and lower casing 131A, 131B that define a stepped through hole, that is, the through hole 140 with the circular groove formed in the inner periphery thereof, such that the large-diameter portion 112*b* of the rubber stopper 112 is engaged with the stepped through hole for fixing the rubber stopper 112 to the casing 131. This configuration, however, increases the manufacturing costs of the ink cartridge 100. Further, because it is not possible to insert the rubber stopper 112 into the through hole 140 in a condition where the upper and lower casing 131A, 131B are engaged with each other, mounting process of the rubber stopper 112 onto the casing 131 is not easy.

Also, a surface area of the ink outlet 110 that contacts the rubber stopper 112 is relatively small, so that sealability for preventing ink leakage through a sealing surface between the ink outlet 110 and the rubber stopper 112 is insufficient, causing undesirable leakage of ink.

Because the ink outlet has a three-dimensional shape with its circular cross-section or the like, a process for sealing a joint portion between the periphery of the ink outlet sealed to the sheet and the joined edges of the sheet is difficult, so that ink easily leaks through the joint portion.

Further, in FIG. 2, even when the two sheets 201*a* and 201*b* separate from each other as ink is introduced into the ink accommodating pouch 200, the angles 41 formed between the sheets 201*a* and 201*b* from the edges toward the center as are acute angles having a small interval near the junctions 202. Furthermore, the junction 202 on each side protrudes outside an accommodating portion of the ink accommodating pouch 200. This configuration produces a small ratio of cross-sectional surface area of the ink accommodating pouch 200 to a surface area (a project area of widthwise surface) of the sheet 201*a*, 201*b*. Therefore, in order to accommodate the ink accommodating pouch 200 filled with ink inside a flat, square ink cartridge, such as the casing 100 shown in FIG. 1, dimensions of the ink cartridge must be large. For this reason, dimensions of the inkjet recording device also are increased, preventing a compact design.

In view of forgoing, it is an object of the present invention to overcome the above problems, and also to provide an ink housing device that reliably prevents leakage of ink and that allows a user to easily mount an ink accommodating pouch.

It is another object of the present invention to provide an ink accommodating pouch capable of reliably preventing ink leakage.

It is also an object of the present invention to provide an ink accommodating pouch for an inkjet recording device having an increased projected area of the widthwise surface on the pouch.

In order to overcome and other object, according to the present invention, there is provided an ink accommodating device including a casing, an ink accommodating pouch, an ink outlet, and a sealing member. The casing has sidewalls. One of the sidewalls is formed with a mounting hole. The ink accommodating pouch is accommodated in the casing. The ink outlet is provided to the ink accommodating pouch and formed with a through hole. The sealing member is formed of a resilient material and seals off the through hole of the ink outlet. The sealing member is engaged inside the mounting hole by force fitting the sealing member into the mounting hole.

There is also provided an ink accommodating pouch including a pouch and an ink outlet provided to the pouch. The pouch is formed of a single sheet folded in half whose edges are sealed to form a junction, and the ink outlet is attached to a surface of the single sheet at a position other than the junction.

Further, there is provided an ink accommodating pouch including a pouch and an ink outlet provided to the pouch.

The pouch has an upper sheet portion and a lower sheet portion both formed of a synthetic resin. The upper sheet portion has an edge, and the lower sheet portion has an edge attached to the edge of the upper sheet portion to form a junction The junction protrudes inward of the pouch.

BRIEF DESCRIPTION OF THE DRAWINGS

In the drawings:

FIG. 6(*b*) is a perspective explanatory view showing a process of producing the ink accommodating pouch according to the first embodiment of the present invention;

FIG. 6(*c*) is a perspective explanatory view showing a process of producing the ink accommodating pouch according to the first embodiment of the present invention;

FIG. 6(*d*) is a perspective view of the ink accommodating pouch according to the first embodiment of the present invention;

FIG. 12(*b*) is a perspective view of the ink accommodating pouch according to the second embodiment of the present invention;

FIG. 13(*b*) is a perspective view showing a process of producing the ink accommodating pouch according to the third embodiment of the present invention;

FIG. 13(*c*) is a perspective partial view of the ink accommodating pouch according to the third embodiment of the present invention;

FIG. 14 is a cross-sectional view of a multilayer sheet which the ink accommodating pouch according to the third embodiment of the present invention is made of;

FIG. 17(*b*) is a perspective view showing a process of producing the ink accommodating pouch according to the fourth embodiment of the present invention;

FIG. 18(*b*) is a perspective view showing a process of producing the ink accommodating pouch according to the fifth embodiment of the present invention.

PREFERRED EMBODIMENTS OF THE PRESENT INVENTION

Next, an inkjet recording device according to an embodiment of the present invention will be described while referring to the attached drawings.

Figure 3:
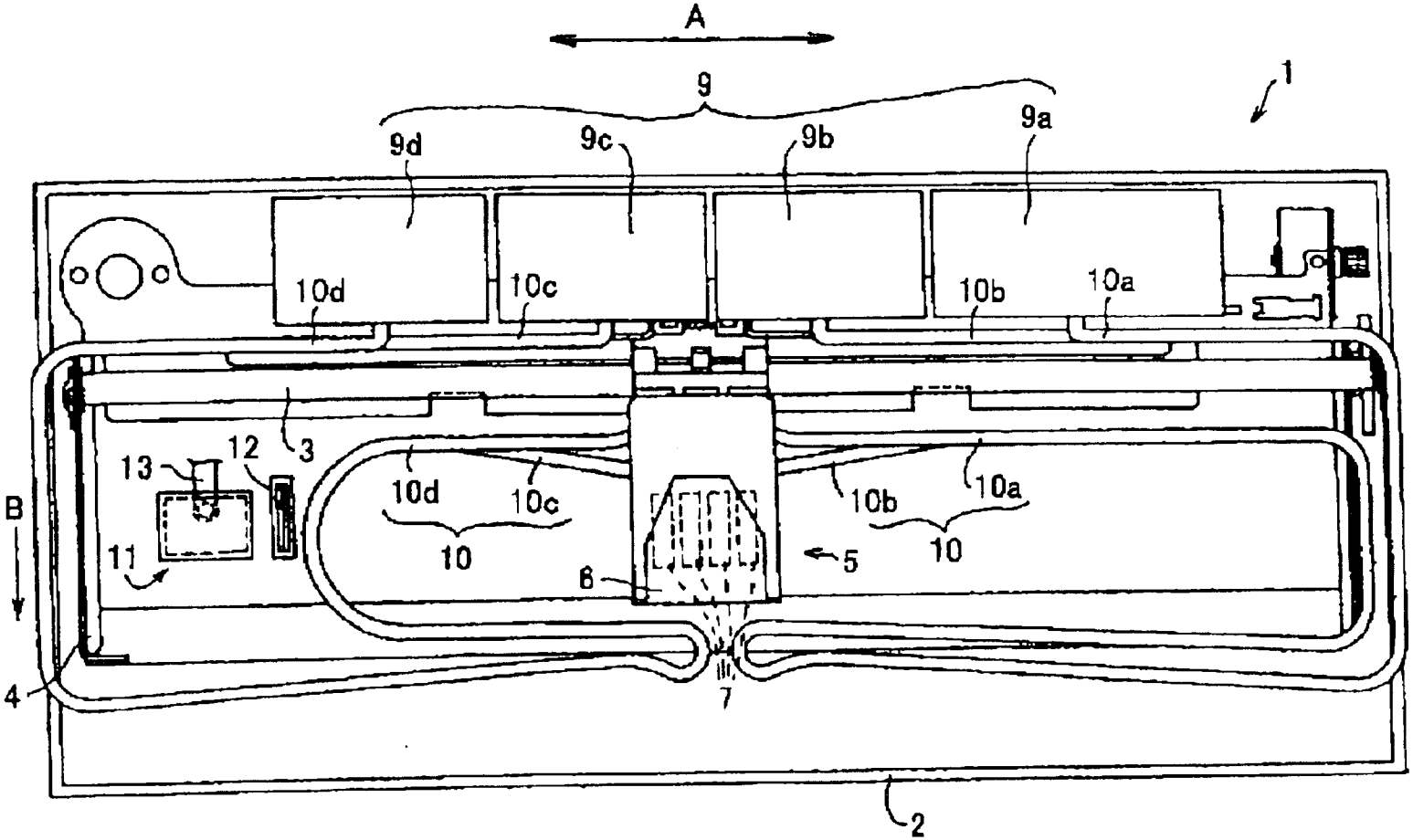
FIG. 3 is a plan view showing overall configuration of an inkjet recording device according to an embodiment of the present invention.

First, an overall configuration of an inkjet recording device 1 will be described with reference to FIG. 3. As shown in FIG. 3, the inkjet recording device 1 includes a main case 2, a guide rail 3, a frame 4, a carriage 5, and a head unit 6. The frame 4 is disposed inside the main case 2. The guide rail 3 extends in a widthwise direction indicated by an arrow A, and both lengthwise ends of the guide rail 3 are fixed in the frame 4. The carriage 5 is mounted on the guide rail 3. A driving mechanism including a timing belt, a drive motor, and the like (not shown) reciprocally moves the carriage 5 in the widthwise direction A along the guide rail 3 over a prescribed interval. The head unit 6 is detachably mounted in the bottom of the carriage 5, and includes four print heads 7 arranged in a row for ejecting four colors of ink. Each print head 7 is formed with a plurality of ejection channels in a bottom. Although not shown in the drawing, the inkjet recording device 1 further includes a transporting mechanism that transports a recording sheet in a sheet feed direction indicated by an arrow B along a predetermined sheet feed path.

Four ink cartridges 9*a*, 9*b*, 9*c*, 9*d* (hereinafter collectively referred to as "ink cartridges 9") are disposed side by side below the sheet feed path. Each ink cartridge 9 accommodates one of four colors of ink, i.e., magenta, yellow, cyan, and black. Ink supply lines 10*a*, 10*b*, 10*c*, 10*d* (collectively referred to as "supply lines 10") are formed of a synthetic resin or other material having flexibility. Each ink supply line 10 includes a base end mounted with a pointed hollow needle 29 shown in FIG. 8, and an opposite end connected to one of four joints (not shown) of the carriage 5. The needle 29 is inserted into the ink cartridge 9 in a manner describe later. With this configuration, the ink supply lines 10 fluidly connect the ink cartridges 9 to the corresponding print heads 7 via the carriage 5 for supplying ink from the ink cartridges 9 to the print heads 7.

A suction cap 11, a wiper blade 12, and a suction pipe 13 are disposed on the left end in the main case 2 (within a moving range of the carriage 5) so as to confront the print heads 7 when the carriage 5 is located at a predetermined purging position. The wiper blade 12 is for wiping a nozzle surface of each print head 7 when the carriage 5 is moved to the purging position. The suction cap 11 is for covering the nozzle surfaces of the print heads 7 to form a close seal during purging operations. The suction pipe 13 is connected to the suction cap 11 at one end and mounted with a pointed hollow needle 28 shown in FIG. 7 on an opposite end.

Figure 4:
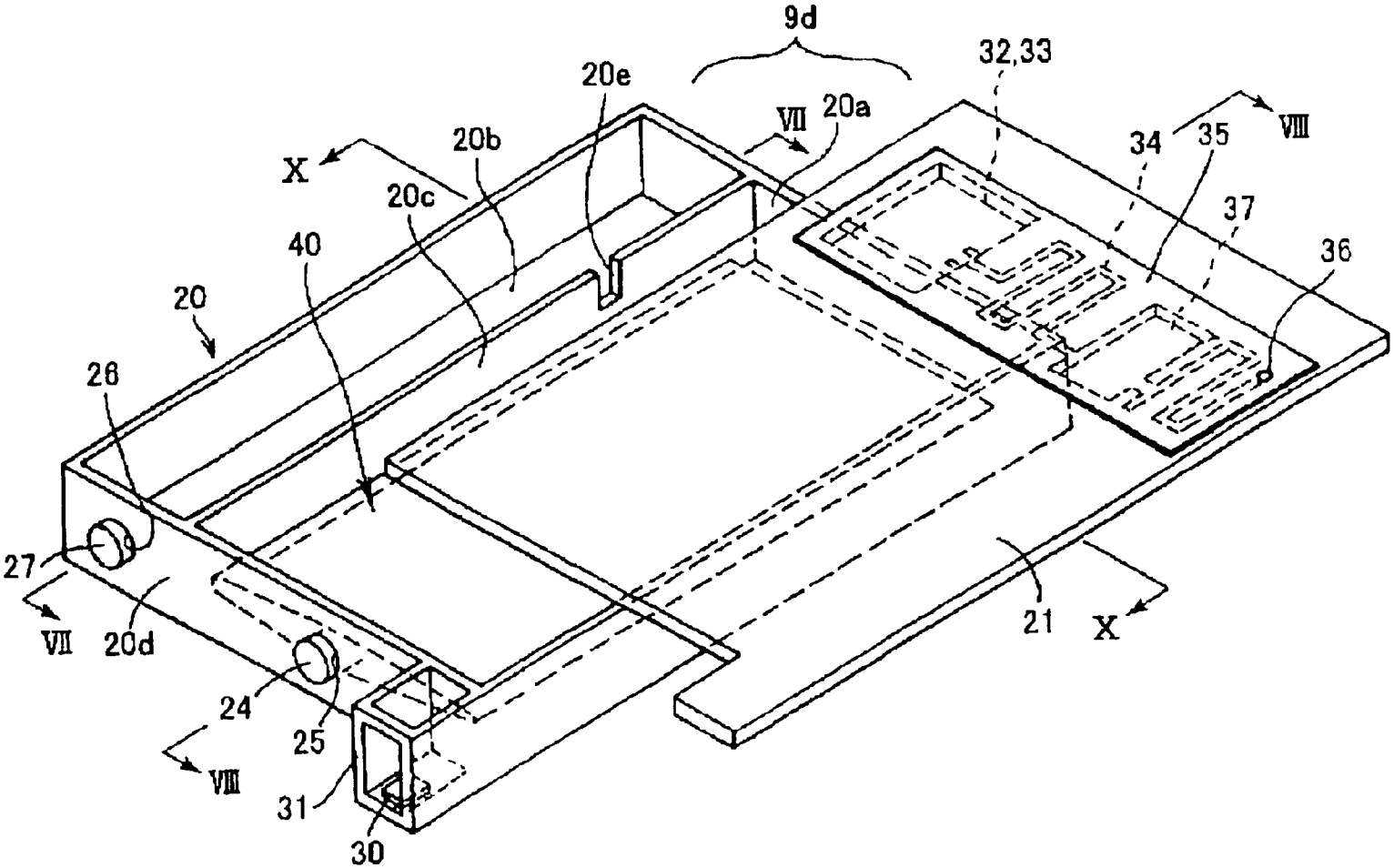
FIG. 4 is an exploded perspective view of an ink cartridge for black ink used in the inkjet recording device of FIG. 1.

Next, configuration of the ink cartridge 9*d* for black ink, which is the most commonly used ink, will be described. As shown in FIG. 4, the ink cartridge 9*d* includes a flat box-like casing 20, a cover 21 for covering a top surface of the casing 20, and an ink accommodating, pouch 40 disposed inside the casing 20. The casing 20 is formed of a synthetic resin material to approximately rectangular in shape. The casing 20 is partitioned into an accommodating chamber 20*a* and a waste ink introducing chamber 20*b* having a smaller volume than the accommodating chamber 20*a* by a partitioning wall 20*c*. The accommodating chamber 20*a* accommodates the ink accommodating pouch 40.

A left sidewall 20*d* of the casing 20 is formed with a mounting hole 25 and a connection hole 26, which a sealing member 24 and a sealing member 27 are inserted into and seal off, respectively.

Here, although not shown in the drawings, the ink cartridges 9*a*, 9*b*, 9*c* have the similar configuration as that of the ink cartridge 9*d* with exception that the ink cartridges 9*a*, 9*b*, 9*c* do not necessarily include the partitioning wall 20*c*, i.e., the waste ink introducing chamber 20*b*.

The ink accommodating pouch 40 accommodates ink for supplying to a corresponding one of the print heads 7 that is an print head 7 for black ink in this example, and as shown in FIG. 6(*d*), the ink accommodating pouch 40 includes an ink extraction outlet 23 and the sealing member 24 engaged with the ink extraction outlet 23.

Figure 8:
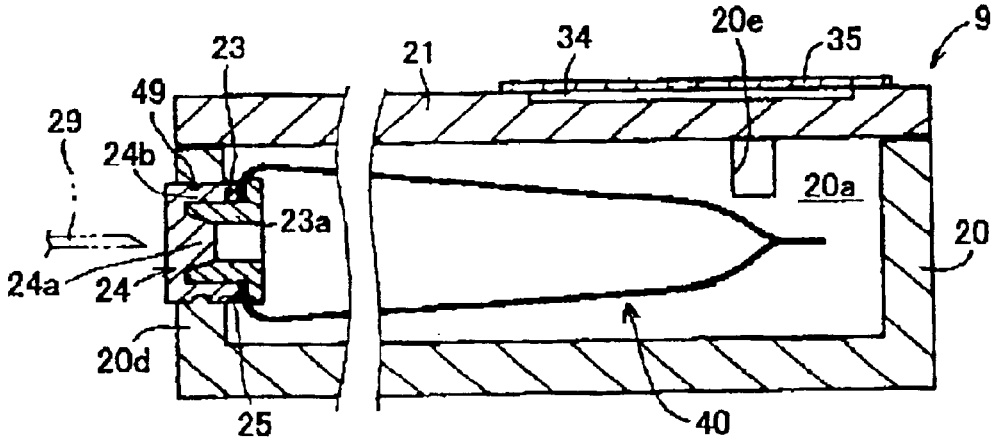
FIG. 8 is a cross-sectional view of the ink cartridge taken along a line VIII—VIII of FIG. 4 with the cover placed on the casing.

The needle 29 shown in FIG. 8 that is connected to the print head 7 via the ink supply tube 10 is inserted through the sealing member 24 and the ink extraction outlet 23 into the ink accommodating pouch 40. With this configuration, the ink accommodated in the ink accommodating pouch 40 is supplied to the corresponding print head 7 through the needle 29, the ink supply tube 10, and the carriage 5.

Figure 7:
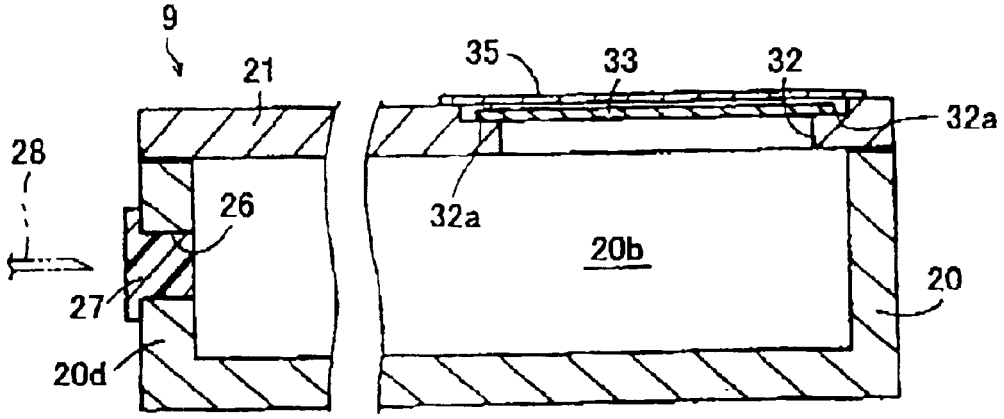
FIG. 7 is a cross-sectional view of the ink cartridge taken along a line VII—VII of FIG. 4 with a cover placed on a casing.

Also, the needle 28 shown in FIG. 7 that is connected through the suction pipe 13 to the purging cap 11 is inserted through the sealing member 27 into the waste ink introducing chamber 20*b*. With this configuration, waste or defective ink drawing out of the print heads 7 during the purging operations is discharged into the waste ink introducing chamber 20*b* along with air bubbles contained in the waste ink.

The defective ink collected into the waste ink introducing chamber 20*b* in this manner is introduced into the accommodating chamber 20*a* through a connection port 20*e* formed in the partitioning wall 20*c* when the volume of the ink accommodating pouch 40 decreases as ink is expended. Therefore, the waste ink introducing chamber 20*b* do not need a large volume, so that the ink cartridge 9*d* can have a compact size.

The sealing members 24 and 27 are formed of an elastic member, such as silicon rubber, urethane rubber, nitrile rubber (NBR), isoprene rubber, butylenes rubber, or fluorine rubber. Since it is desirable that the needles 29, 28 be able to penetrate through the sealing members 24, 27, respectively, and that the hole in the sealing members 24 and 27 left when the needles 29 and 28 are removed therefrom be hermetically resealed by the elasticity of the rubber material of the sealing members 24 and 27, a silicon gum with high resilient restoration is preferable for the material to form the sealing members 24 and 27.

Figure 9:
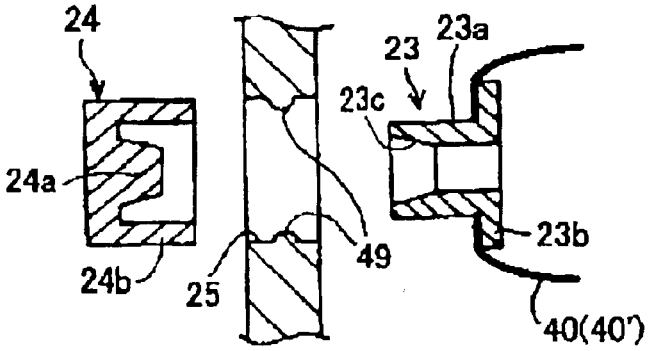
FIG. 9 is an enlarged cross-sectional view of a sealing member, a sidewall of the casing, and an ink extraction outlet.

The ink extraction outlet 23 and the sealing member 24 will be described more in detail. As shown in FIG. 6(*a*), the ink extraction outlet 23 is formed integrally with a sleeve 23*a* and a flange 23*b*. The flange 23*b* has a ring shape and is attached to one end of the sleeve 23*a* to radially outwardly extend from the sleeve 23*a*. Both the sleeve 23*a* and the flange 23*b* are formed with a through hole 23*c* penetrating therethrough. As shown in FIG. 9, the through hole 23*c* has a wider cross section toward its one end.

As shown in FIG. 8, the sealing member 24 is integrally formed with a stopper portion 24*a* and an outer sleeve portion 24*b*. The stopper portion 24*a* has a smaller cross section toward its end, and tightly fits inside the through hole 23*c*. In this manner, a sealing portion between the ink extraction outlet 23 and the sealing member 24 where the inner surface, the outer surface, and a tip end surface of the sleeve 23*a* are all in intimate contact with the sealing member 24 has a relatively large area. This ensures the sealing between the ink extraction outlet 23 and the sealing member 24 and thus reliably prevents ink from leaking out of the ink cartridge 9.

As shown in FIG. 9, a protrusion 49 is formed on an inner periphery of the mounting hole 25. The protrusion 49 could be a single ring-shaped protrusion extending in a peripheral direction of the mounting hole 25 or could be a plurality of dots aligned in the peripheral direction. Accordingly, when the sealing member 24 is force fitted inside the mounting hole 25, the protrusion 49 presses the outer sleeve portion 24*b* of the sealing member 24 in a radially inward direction.

With this configuration, even when the needle 29 is inserted into or pulled out from the sealing member 24, the sealing member 24 is reliably prevented from disengaging from the mounting hole 25, thereby reliably preventing ink leakage. Moreover, because the protrusion 49 inwardly urges and compresses the sealing member 24, the intimate contact between the ink extraction outlet 23 and the sealing member 24 are improved, so that ink leakage is further reliably prevented.

In FIG. 4, provided on the sidewall 20*d* near the mounting holes 25 and 26 is a memory chip 30 and an electrical contact layout portion 31. The memory chip 30 stores such information as an ink type, applicable inkjet recording devices, and the ink cartridges' history of use. Once the ink cartridge 9 is mounted in a recording device, then the ink cartridge 9 is determined not a new product. The electrical contact layout portion 31 is for connecting the memory chip 30 to a circuit board of the inkjet recording device 1.

Figure 10:
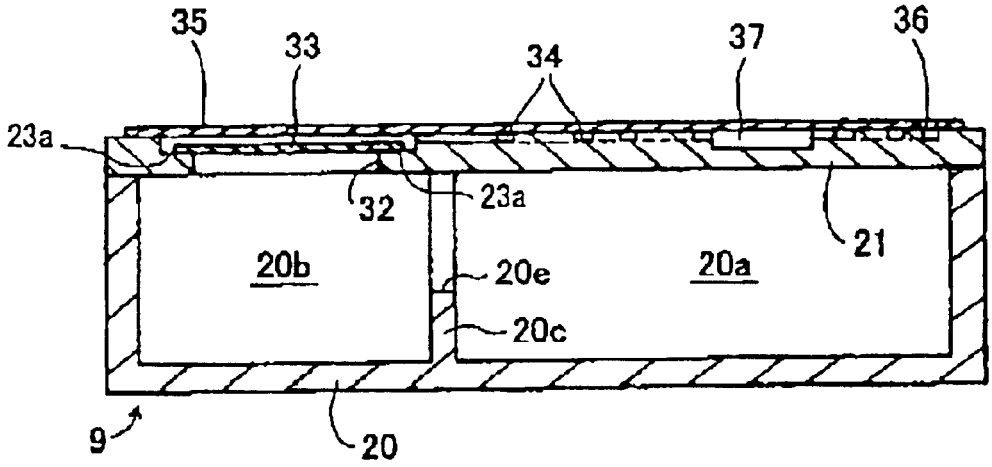
FIG. 10 is a cross-sectional view of the ink cartridge taken along a line X—X of FIG. 4 with the cover placed on the casing.

Next, the cover 21 will be described in detail. As shown in FIG. 4, the cover 21 is formed with a stepped opening 32, a thin labyrinth channel 34, and an ink trap 37. As shown in FIG. 10, an air permeable film 33 is adhered to a stepped portion 32*a* inside the stepped opening 32 for dividing the opening 32 into an outer space and an inner space. The air permeable film 33 allows air to pass through, but not fluid like ink. The thin labyrinth channel 34 is formed in a twisting and turning pattern in an outer surface of the cover 21 in fluid communication with th outer space of the opening 32. The ink trap 37 having a wide surface area is formed as an indentation in the middle of the labyrinth channel 34.

An air non-permeable film 35 is adhered to the outer surface of the cover 21 to cover the entire stepped opening 32, the labyrinth channel 34, and the ink trap 37. The air non-permeable film 35 is not permeable to both air and liquid. The air non-permeable film 35 is formed with a penetrating hole 36 that connects an end of the labyrinth channel 34 to the external air.

With this configuration, air contained in the waste ink that is collected into the waste ink introducing chamber 20*b* is discharged out of the ink cartridge 9*d* through the stepped opening 32, air permeable film 33, the air non-permeable film 35, the ink trap 37, and the penetrating hole 36 while preventing the waste ink from leaking out of the ink cartridge 9*d*.

Here, the ink trap 37 prevents ink from passing out through the labyrinth channel 34 in the unlikely event that ink leaks through the adhered surface of the air permeable film 33 attached to the stepped portion 32*a*.

Figure 5:
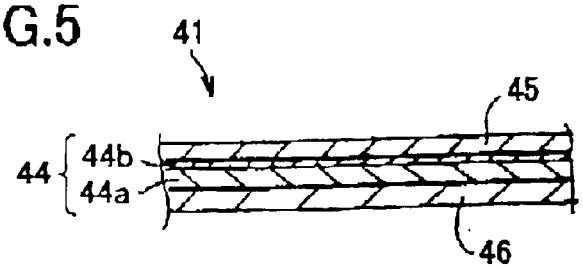
FIG. 5 is a cross-sectional view of a multilayer sheet.
Figure 6A:
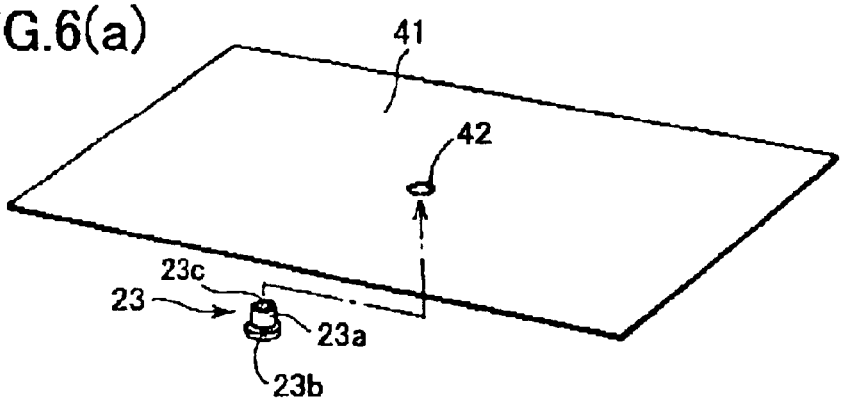
FIG. 6(*a*) is a perspective explanatory view showing a process of producing an ink accommodating pouch according to a first embodiment of the present invention.
Figure 6B:
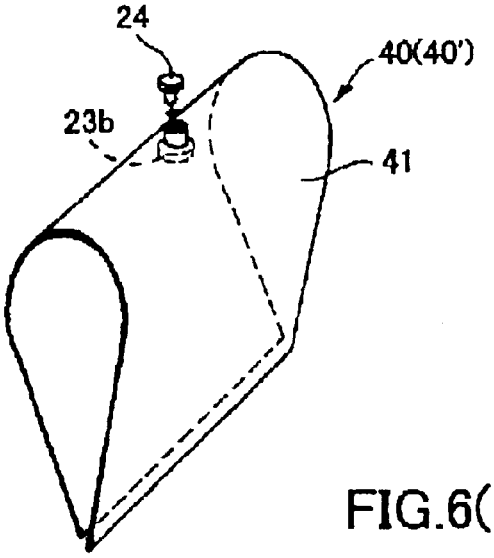
Figure 6C:
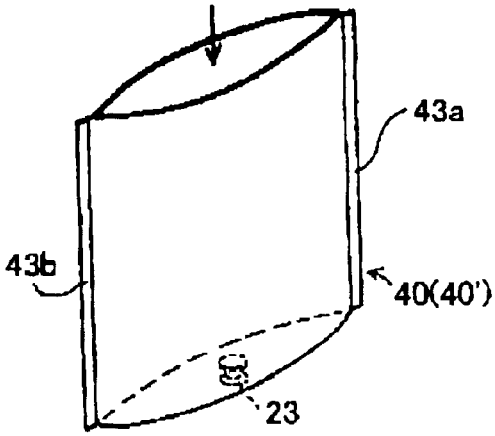
Figure 6D:
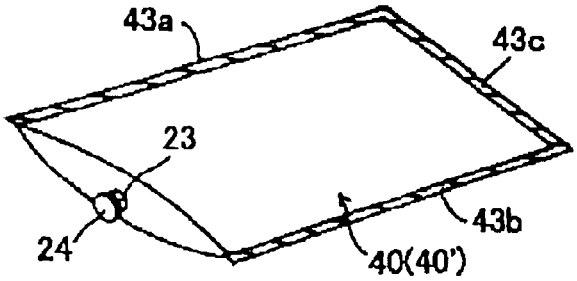

Next, processes of producing the ink accommodating pouch 40 will be described. First, a sheet 41 formed of a synthetic resinous material in a rectangular shape shown in FIG. 5 is prepared. The sheet 41 includes a vacuum deposition film 44 having a polyethylene terephthalate film 44*a* and an alumina or silica layer 44*b* formed by vacuum deposition on one surface of the polyethylene terephthalate film 44*a*. A nylon resin film 45 is bonded to a top surface of the vacuum deposition film 44, and a polypropylene resin or polyethylene film 46 is bonded to a bottom surface of the vacuum deposition film 44.

Next, as shown in FIG. 6(*a*), the sheet 41 is formed with a through hole 42 in the middle. The sleeve 23*a* of the ink extraction outlet 23 is inserted into the hole 42 from the film 46 side so that the flange 23*b* abuts the film 46. Then, the flange 23*b* is adhered to the sheet 41 by adhesive or heat sealing. Here, in the present embodiment; the ink extraction outlet 23 is formed of polypropylene resin or polyethylene so that the ink extraction outlet 23 and the heat sealing surfaces on the sheet 41 are formed of the same material in order to improve the sealability of the parts.

Then, as shown in FIG. 6(*b*), the sealing member 24 is engaged with the ink extraction outlet 23, and the sheet 41 is folded in haft such that the flange 23*b* locates inside. As shown in FIG. 6(*c*), right, left, and bottom edges are oriented in the same direction and overlap one another. The aligned right and left edges except the bottom edge are fused completely by heat (heat sealed) or an adhesive, thereby forming junctions (fused parts) 43*a*, 43*b* as shown in FIG. 6(*c*). In this manner a pouch 40' is produced. Then the pouch 40' is filled with ink through the bottom opening, and then the bottom edge is fused by heat to form a junction 43*c* as shown in FIG. 6(*d*). Alternatively, first the bottom edges is fused by heat to form the junction 43*c*, and next the ink is filled into the pouch 40' through the through hole 23*c* of the ink extraction outlet 23 before the ink extraction outlet 23 is engaged with the sealing member 24.

In this manner, the ink accommodating pouch 40 is produced. Because the sealing surface of the sheet 41 is of the Polypropylene resin or polyethylene film 46, the sealability of the junctions 43*a*, 43*b* is improved.

Thus produced ink accommodating pouch 40 is placed inside the accommodating chamber 20*a*, and the sealing member 24 is force fitted into the mounting hole 25 for sealing off the mounting hole 25. The cover 21 is adhered with an adhesive or the like to the casing 20 to form a hermetic seal. Once the ink in the ink accommodating pouch 40 is completely expended, the ink cartridge 9*d* is replaced.

As described above, ink accommodating pouch 40 is attached to the ink cartridge 9 by merely inserting the sealing member 24 of the ink accommodating pouch 40 into the mounting hole 25 from a side, the ink accommodating pouch 40 can easily be attached to the ink cartridge 9. Also, because the mounting hole 25 has a simple configuration, production costs of the ink cartridge 9 can be reduced.

Also, because the through hole 42 is the only portion that might cause ink leakage, such ink leakage is reliably prevented by ensuring the heat sealing between the sleeve 23*a* and the sheet 41.

As described above, the ink extraction outlet 23 is adhered to a flat surface of the sheet 41, and then the edges of the sheet 41 are fused. Therefore, there is no need to seal three-dimensional parts. Because the sealing surfaces of the sleeve 23*a* and the sheet 41 are both flat, the sealing between the sleeve 23*a* and the sheet 41 is improved, thereby further reliably preventing ink leakage.

Further because the ink extraction outlet 23 is sealed to the flat surface of the sheet 41, the sealed surface between the ink extraction outlet 23 and the sheet 41 increases, simplifying sealing process.

Moreover, because the ink extraction outlet 23 is located where the sheet 41 is folded, but not on a junction where edges are fused, when the pouch 40' is filled with ink, the sheet 41 near the folded part swells to a protruding curved shape on the outside of the pouch 40', enabling the ink accommodating pouch 40 to accommodate an increased amount of ink.

Next, a modification of the first embodiment will be described while referring to FIG. 11. Here, it should be noted that components that are same as those of the first embodiment will be assigned with the same numberings, and their explanations will be omitted in order to avoid duplication in explanation.

Figure 11:
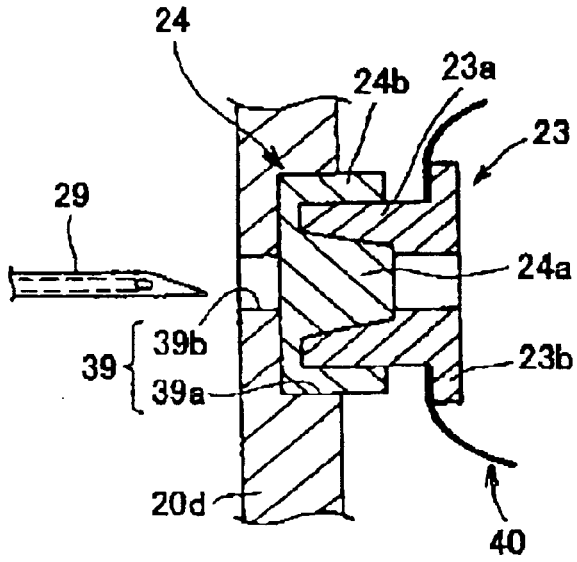
FIG. 11 is a cross-sectional view of an ink cartridge according to a modification of the first embodiment.

As shown in FIG. 11, the sidewall 20*d* of the case 20 is formed with a stepped hole 39, instead of the mounting hole 25. The stepped hole 39 has a large-diameter portion 39*a* formed in an inner side of the sidewall 20*d* and a small-diameter portion 39*b* formed an outer side of the sidewall 20*d* in connection with the large-diameter portion 39*a*. The sealing member 24 is engaged inside the large-diameter portion 39*a*. With this configuration, the small-diameter groove 39*b* serves as an index that tells a user where to insert the hollow needle 29, so that the needle 29 will directly reach the ink inside the ink accommodating pouch 40. Also, when the needle 29 is outwardly pulled out from the stopper portion 24*a*, the sealing member 24 is reliably prevented from disengaging from the stepped hole 39.

Figure 12A:
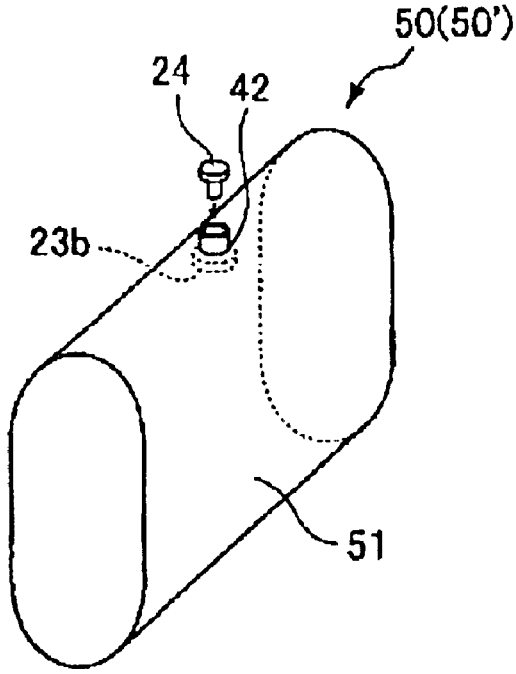
FIG. 12(*a*) is a perspective view showing a process of producing an ink accommodating pouch according to a second embodiment of the present invention.
Figure 12B:
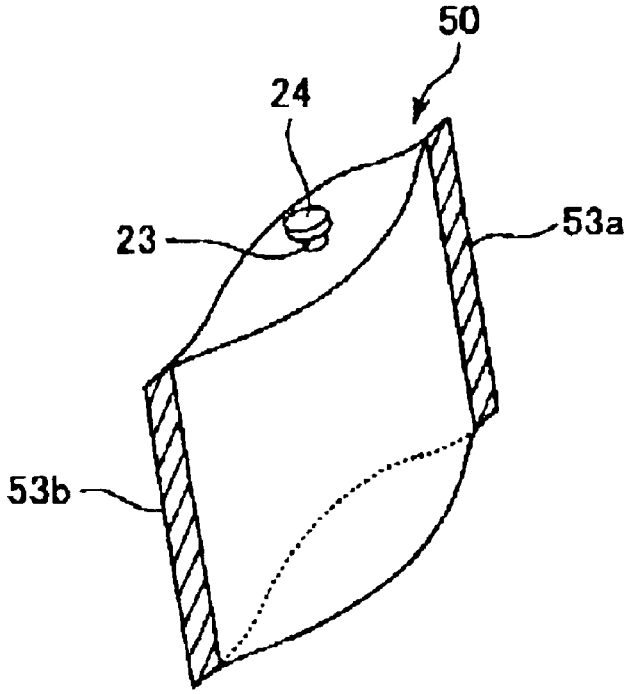
Figure 13A:
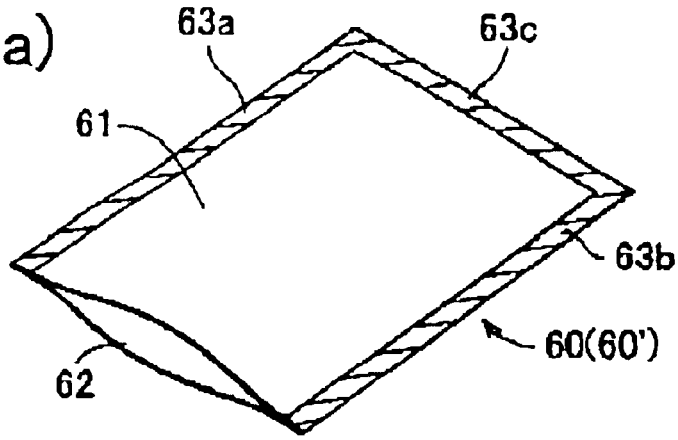
FIG. 13(*a*) is a perspective view showing a process of producing an ink accommodating pouch according to a third embodiment of the present invention.
Figure 13B:
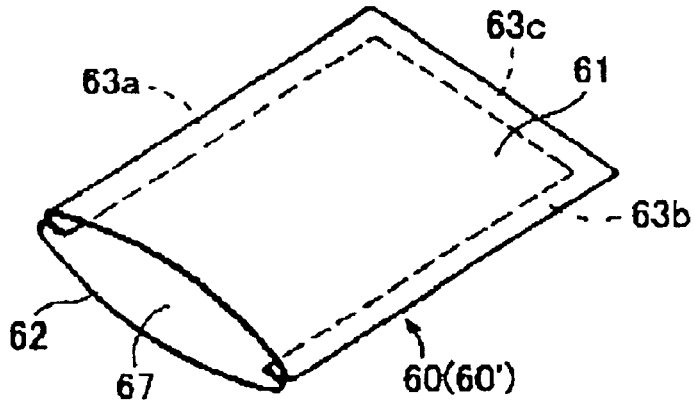
Figure 13C:
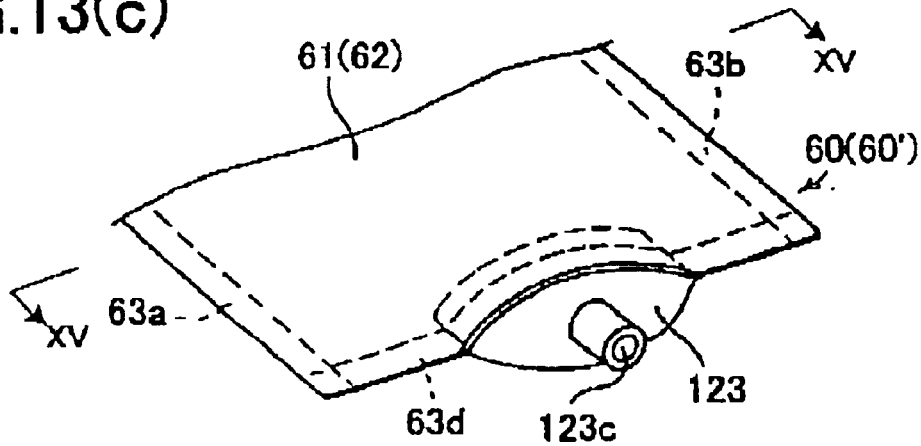

Next, processes of producing an ink accommodating pouch 50 according to a second embodiment of the preset invention will be described while referring to FIGS. 12(*a*) and 12(*b*). As shown in FIG. 12(*a*), first a sheet 51 preformed in a cylindrical shape is prepared, and a through hole 42 is formed in middle. Next, the sleeve 23*a* is inserted into the through hole 42 from the inside so that the flange 23*b* abuts a sealing surface, i.e., an inner surface, of the sheet 51. Then, the flange 23*b* is fixed to the sealing surface of the sheet 51 by heat sealing or the like. As shown in FIG. 13(*b*), edges on open ends of the cylinder are overlapped in the same direction and heat sealed across the entire overlapped edges to form junctions 53*a* and 53*b* to produce a pouch 50'. Then, the pouch 50' is filled with ink, and the sealing member 24 is engage with the ink extraction outlet 23, so that the ink accommodating pouch 50 is produced. Here, the sheet 51 is formed of the same multilayer sheet as the sheet 41 of the first embodiment. The sealing surface of the sheet 51 and the ink extraction outlet 23 are form d of the same material.

With this configuration, when the pouch 50' is filled with ink, the sheet 51 swells to a protruding curved shape on the outside of the pouch 50', enabling the ink accommodating pouch 50 to accommodate an increased amount of ink.

Figure 14:
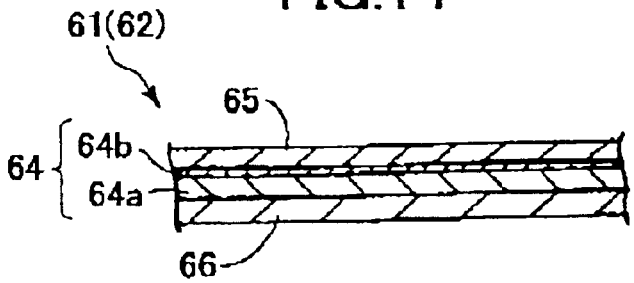

Next, processes of producing an ink accommodating pouch 60 according to a third embodiment of the present invention will be described while referring to FIGS. 13 to 17. First, two sheets 61 and 62 shown in FIG. 14 formed of a synthetic resinous material are prepared. Each sheet 61, 62 is in a rectangular shape, and as shown in FIG. 14. has a vacuum deposition film 64 having a polyethylene terephthalate film 64*a* and an alumina or silica layer 64*b* formed by vacuum deposition on one surface of the polyethylene terephthalate film 64*a*. Polypropylene resin or polyethylene films 65 and 66 are bonded to the top and bottom surfaces of the vacuum deposition film 64.

Then, four edges of both the sheets 61 and 62 overlap each other and are oriented in the same direction. Three of the aligned edges are fused completely by heat (heat sealed), forming junctions (fused parts) 63*a*, 63*b*, and 63*c*.

Because the overlapped surfaces (heat fused surfaces) are formed by the polypropylene resin or polyethylene film 65 or 66, heat fusion is facilitated. Then, as shown in FIG. 13(*b*), a resultant product is turned inside out to form a pouch 60'. As a result, the junctions 63*a*, 63*b*, and 63*c* of the three edges are turned inward and protrude inside the pouch 60'. Next, as shown in FIG. 13(*c*), an ink extraction outlet 123 is disposed in the edge of an opening 67 formed in one side of the pouch 60'. The edge of the opening 67 is sealed together to form a sealed portion 63*d*. In the present embodiment, the ink extraction outlet 123 is formed of polypropylene resin or polyethylene so that the ink extraction outlet 23 is made of the same or a similar material as that of the heat sealing surfaces on the sheets 61 and 62 in order to improve the sealability of the parts.

Figure 16:
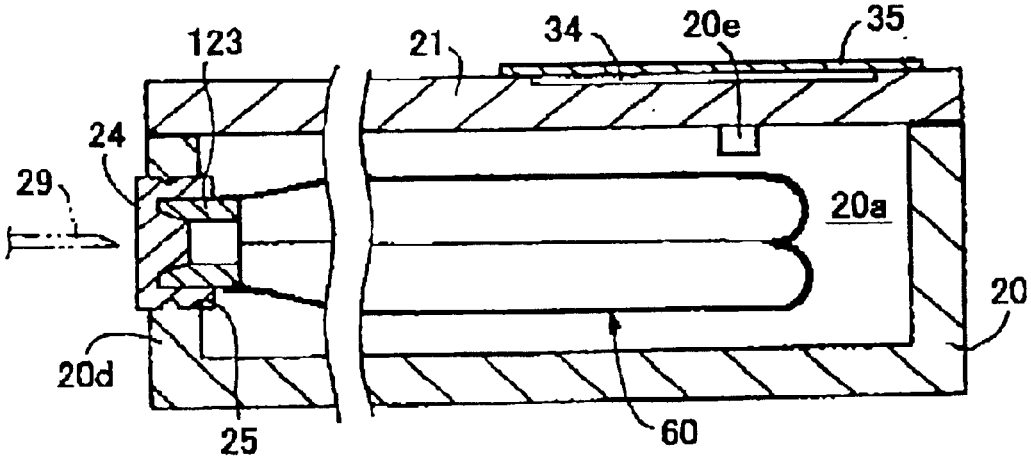
FIG. 16 is a cross-sectional view of the ink accommodating pouch according to the third embodiment of the present invention accommodated in the casing.

Then, ink is introduced into the pouch 60' through the opening 123*c* of the ink extraction outlet 123. By hermetically sealing the opening 123*c* with the sealing member 24, the ink accommodating pouch 60 is produced. Afterwards, the sealing member 24 is force fitted from the accommodating chamber 20*a* into the mounting hole 25 of the case 20 as shown in FIG. 16, and the upper surface of the case 20 is sealed with the cover 21.

Figure 15:
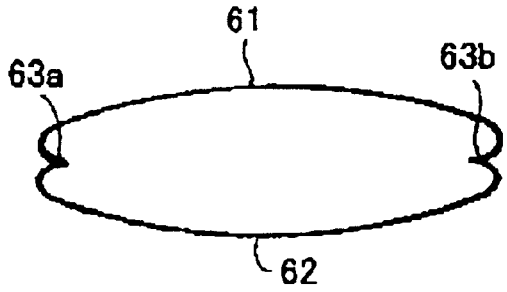
FIG. 15 is a cross-sectional view of the ink accommodating pouch taken along a line XV—XV of FIG. 14.

FIG. 15 shows a cross-sectional shape of the ink accommodating pouch 60 taken along a line XV—XV of FIG. 13(*c*). When the ink accommodating pouch 60 is filled with ink, the sheet 61 and sheet 62 near the junctions 63*a* and 63*b* on the left and right sides of the ink accommodating pouch 60 swell to a protruding curved shape on the outside of the ink accommodating pouch 60. Although not shown in the drawing, the sheets 61 and 62 also expand to a protruding curved shape on the outside of the ink accommodating pouch 60 near the junction 63*c* on the bottom.

Figure 1:
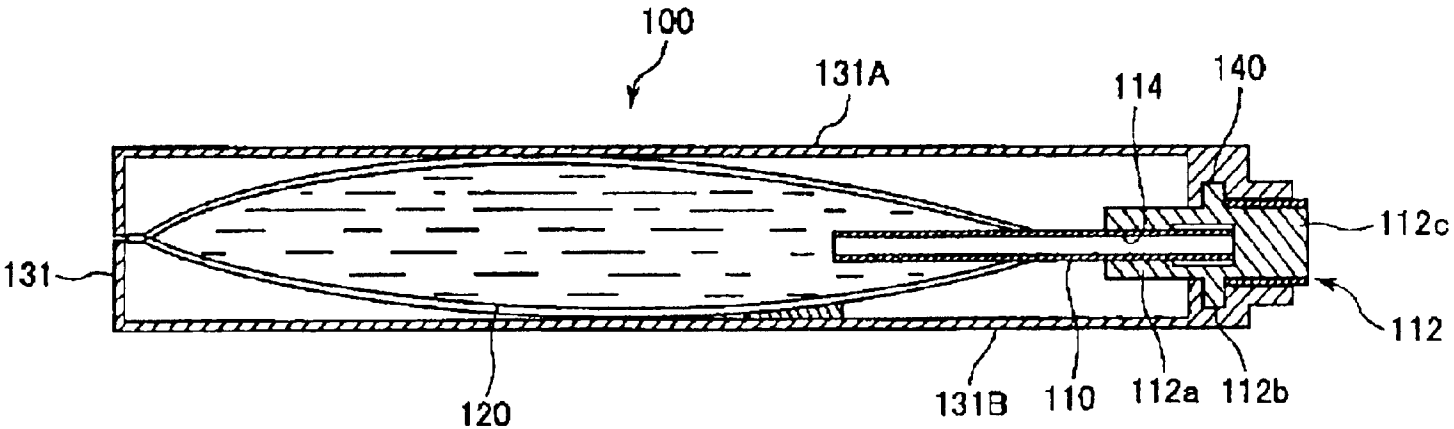
FIG.1 RELATED ART
FIG. 1 is a cross-sectional view of a conventional ink housing device.
Figure 2:
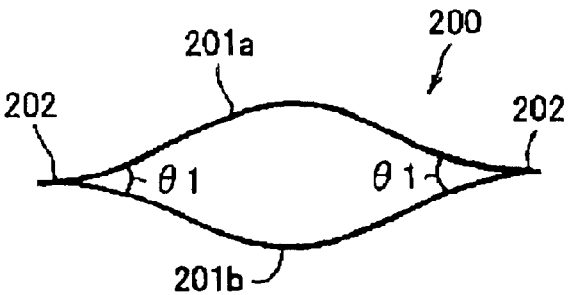
FIG.2 RELATED ART
FIG. 2 is a cross-sectional view of a conventional ink accommodating pouch.

Accordingly, the cross-section of the ink accommodating pouch 60 forms an approximate elliptical shape as shown in FIG. 15. The cross-sectional surface area of the ink accommodating pouch 60 is larger than that of the conventional ink accommodating pouch 200 shown in FIG. 2, wherein the edges formed at the two junctions 102 protrude outward from the ink accommodating pouch 200. Further, since the edges formed at the junctions 63*a*, 63*b*, and 63*c* are positioned inside the accommodating portion of the ink accommodating pouch 60, the projected area of the widthwise surface of the ink accommodating pouch 60 is smaller than that of a conventional ink accommodating pouch. Hence, the ink accommodating pouch 60 according to the present invention achieves a larger ratio of ink accommodating volume (volume of ink that can be accommodated in the pouch 60) to the projected area of the widthwise surface of the pouch 60. In other words, the present invention reduces the projected area of the widthwise surface of the ink accommodating pouch 60 when the ink accommodating pouch 60 accommodates a prescribed volume of ink, achieving a more compact size and thereby enabling the ink cartridge 9 itself to be built more compactly.

Figure 17A:
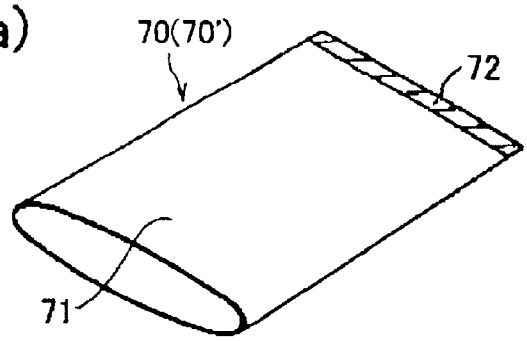
FIG. 17(*a*) is a perspective view showing a process of producing an ink accommodating pouch according to a fourth embodiment of the present invention.
Figure 17B:
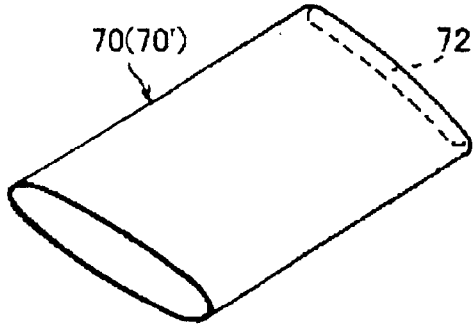

Next, processes of producing an ink accommodating pouch 70 according to a fourth embodiment of the present invention will be described while referring to FIGS. 17(*a*) and 17(*b*). A sheet 71 preformed in a cylindrical shape is cut at a prescribed length (approximately equivalent to the length of the pouch) along a cutting plane orthogonal to the cylindrical axis. As shown in FIG. 17(*a*), the edges on one open end of the cylinder are overlapped in the same direction and heat sealed across the entire overlapped edge to form a junction 72. Then, as shown in FIG. 17(*b*), the ink accommodating pouch 70 is turned inside out to form a pouch 70' such that the edges of the junction 72 protrude inside the pouch 70'. The ink extraction outlet 23 is disposed in the open edge of the pouch 70' in the same manner as in the third embodiment, and heat sealed. Here, the sheet 71 is formed of multilayer sheet as in the third embodiment. The heat sealed surface and the ink extraction outlet 23 are formed of materials that can be heat sealed.

In the ink accommodating pouch 70 of the present embodiment, two sheets 71 form a protruding curve outside the ink accommodating pouch 70 near the junction 72 on the bottom edge of the ink accommodating pouch 70, thereby achieving a greater volume in the ink accommodating portion than a conventional ink accommodating pouch. Further, since the edge of the junction 72 is positioned inside the ink accommodating pouch 70 (the ink accommodating portion), the present invention can reduce the projected area of the widthwise surface when the ink accommodating pouch 70 accommodates a prescribed volume of ink. Hence, the ink accommodating pouch 70 can be made more compact, thereby enabling the ink cartridge 9 itself to be made more compact.

Figure 18A:
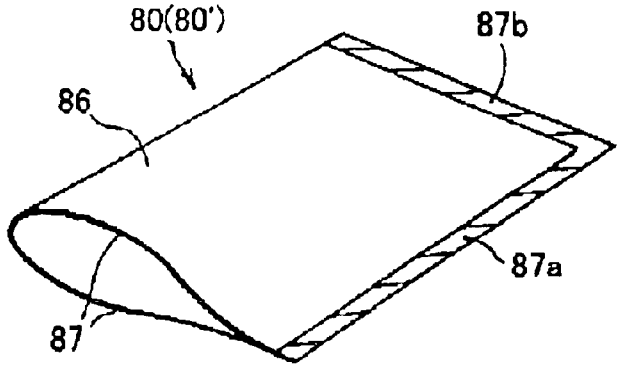
FIG. 18(*a*) is a perspective view showing a process of producing an ink accommodating pouch according to a fifth embodiment of the present invention.
Figure 18B:
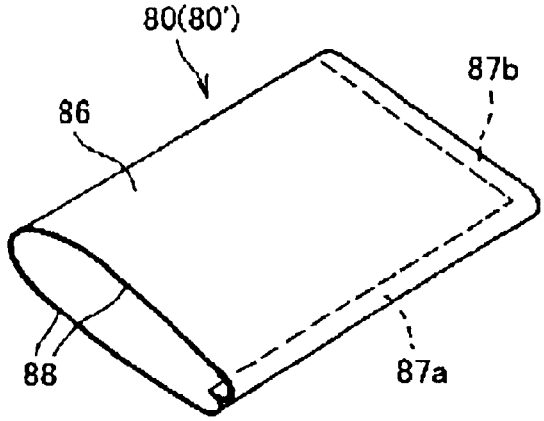

Next, processes of producing an ink accommodating pouch 80 according to a fifth embodiment of the present invention will be described while referring to FIGS. 18(*a*) and 18(*b*). One rectangular sheet 86 is folded in half at the center such that the edges of the sheet 86 are overlapped and oriented in the same direction. As shown in FIG. 18(*a*), of the three aligned edges, two edges are heat sealed across their entire length, forming junctions 87*a* and 87*b*. The resultant produce is turned inside out to form a pouch 80', wherein the edges of the junctions 87*a* and 87*b* protrude inside the pouch 80' as shown in FIG. 18(*b*). As in the above-described embodiments, the ink extraction outlet 123 is disposed in an opened edge 88, the opened edge 88 is heat sealed, and ink is introduced to produce the ink accommodating pouch 80.

The sheet 86 is formed of the same multilayer sheet as in the above described third embodiment. The heat sealed surface and the ink extraction outlet 123 are formed of materials that can be heat sealed. The ink accommodating pouch 80 of the present embodiment has the same operations and effects as those described in the previous third and fourth embodiments.

As described above, by turning a pouch inside out in order that junctions protrude inside the pouch, the two sheets expand in protruding curved portions on the outside of the pouch near the junctions when the pouch is filled with ink, producing a larger ink accommodating capacity than the conventional ink accommodating pouch with the joined edges protruding outward. Moreover, since the edges of the pouch at the junctions are positioned in the ink accommodating area of the pouch, the projected area of the pouch's widthwise surface can be made smaller than that of a conventional ink accommodating pouch. Further, an ink accommodating pouch for accommodating a prescribed amount of ink can be made more compact, thereby making the ink cartridges more compact, and ultimately reduces the size of the inkjet recording device.

While some exemplary embodiments of this invention is have been described in detail, those skilled in the art will recognize that there are many possible modifications and variations which may be made in these exemplary embodiments while yet retaining many of the novel features and advantages of the invention.

For example, the flange 23*b* could be dispensed with as long as the ink extraction outlet 23 is formed with the through hole 23*c*.

What is claimed is:

1. An ink accommodating device comprising:

a casing having sidewalls, one of the sidewalls being formed with a mounting hole;

an ink accommodating pouch accommodated in the casing;

an ink outlet provided to the ink accommodating pouch, the ink outlet being formed with a through hole; and a sealing member formed of a resilient material, the sealing member sealing off the through hole of the ink outlet, wherein the sealing member is engaged inside the mounting hole by force fitting the sealing member into the mounting hole and one of the sidewalls is formed with a protrusion on an inner periphery of the mounting hole, the protrusion engaging an outer periphery of the sealing member.

2. The ink accommodating device according to claim 1, wherein the sealing member includes a stopper portion and an outer sleeve portion, wherein the stopper portion is in intimate contact with an inner periphery of the through hole of the ink outlet, and the outer sleeve portion is in intimate contact with an outer periphery of the ink outlet.

3. The ink accommodating device according to claim 2, wherein the one of the sidewalls is formed with a protrusion formed on an inner periphery of the mounting through hole, the protrusion engaging an outer periphery of the outer sleeve portion.

4. The ink accommodating device according to claim 1, wherein the ink accommodating pouch is formed of a single sheet folded in half whose edges are sealed to form a junction, and the ink outlet is attached to a surface of the single sheet at a position other than the junction.

5. The ink accommodating device according to claim 4, wherein the ink accommodating pouch is formed with a through hole, and the ink outlet includes a sleeve and a flange attached to one end of the sleeve to radially outwardly extend from the sleeve, the sleeve being inserted into the through hole, the flange being attached to the surface of the single sheet.

6. The ink accommodating device according to claim 1, wherein the ink accommodating pouch includes an upper sheet portion having an edge and a lower sheet portion having an edge attached to the edge of the upper sheet portion to form a junction, the junction protruding inward of the pouch.

7. An ink accommodating pouch comprising:

a pouch; and an ink outlet provided to the pouch, wherein the pouch is formed of a single sheet in a cylindrical shape whose edges on open ends sealed to form a junction, and the ink outlet is attached to a surface of the single sheet at position other than the junction.

8. The ink accommodating pouch according to claim 7, wherein the ink outlet is made of a synthetic resin that is heat sealed to the surface of the single sheet, and the single sheet is made of a synthetic resin that allows to heat seal the edges of the folded single sheet.

9. The ink accommodating pouch according to claim 7, wherein the pouch is formed with a through hole, and the ink outlet includes a sleeve and a flange attached to one end of the sleeve to radially outwardly extend from the sleeve, the sleeve being inserted into the through hole, the flange being attached to the surface of the single sheet.

10. The ink accommodating pouch according to claim 9, further comprising a sealing member, wherein the ink outlet is formed with a through hole penetrating through the sleeve, and the sealing member seals off the through hole of the sleeve.

11. ink accommodating pouch comprising:

a pouch having an upper sheet portion and a lower sheet portion both formed of a synthetic resin; and an ink outlet provided to the pouch, wherein the upper sheet portion has an edge, and the lower sheet portion has an edge attached to the edge of the upper sheet portion to form a junction, the junction protruding inward of the pouch.

12. The ink accommodating pouch according to claim 11, wherein the ink outlet is made of a synthetic resin that is heat sealed to one of the upper and lower sheet portions, and the upper and lower sheet portions are made of a synthetic resin that allows to heat seal the edges.

13. The ink accommodating pouch according to claim 11, wherein the upper sheet portion and the lower sheet portion are formed of a single sheet.

* * * * *